US005373826A

United States Patent [19]

Taruya et al.

[11] Patent Number: 5,373,826

[45] Date of Patent: Dec. 20, 1994

[54] IGNITION APPARATUS FOR AN INTERNAL COMBUSTION ENGINE HAVING A CURRENT LIMITING FUNCTION

[75] Inventors: Masaaki Taruya; Mitsuru Koiwa, both of Himeji, Japan

[73] Assignee: Mitsubishi Denki K.K., Tokyo, Japan

[21] Appl. No.: 18,503

[22] Filed: Feb. 17, 1993

[30] Foreign Application Priority Data

Feb. 19, 1992 [JP] Japan ..... 4-006778[U]

[51] Int. Cl.[5] ..... F02P 11/00

[52] U.S. Cl. ..... 123/634

[58] Field of Search ..... 123/644, 606, 609, 611, 123/406, 637; 315/209 T, 209 R; 364/431.04, 431.08, 431.03

[56] References Cited

U.S. PATENT DOCUMENTS

| | | | |
|---|---|---|---|
| 4,030,468 | 6/1977 | Sugiura et al. | 123/644 |
| 4,912,373 | 3/1990 | Moreau | 315/209 R |
| 4,949,697 | 8/1990 | Ookawa | 123/644 |
| 5,033,445 | 7/1991 | Kobayashi et al. | 123/644 |
| 5,050,573 | 9/1991 | Meinders et al. | 123/644 |
| 5,056,497 | 10/1991 | Akagi et al. | 123/609 |
| 5,097,815 | 3/1992 | Oota et al. | 123/606 |
| 5,139,004 | 8/1992 | Gose et al. | 123/644 |
| 5,146,907 | 9/1992 | Sawazaki et al. | 123/644 |
| 5,199,406 | 4/1993 | Taruya et al. | 123/644 |
| 5,199,407 | 4/1993 | Sawazaki et al. | 123/644 |

FOREIGN PATENT DOCUMENTS

| | | | |
|---|---|---|---|
| 3933504 | 10/1988 | Germany | 123/644 |
| 4016307 | 11/1991 | Germany | 123/644 |
| 4215153 | 11/1992 | Germany | 123/644 |
| 523943 | 12/1977 | Japan | 123/644 |
| 21270 | 2/1989 | Japan | 123/644 |
| 90361 | 7/1990 | Japan | 123/644 |

*Primary Examiner*—Raymond A. Nelli

*Attorney, Agent, or Firm*—Sughrue, Mion, Zinn, Macpeak & Seas

[57] ABSTRACT

An ignition apparatus for an internal combustion engine having a current limiting function is simple in construction and can avoid variations In the current limiting values for respective power transistors 103. A current limiting circuit 109 includes a common resistor 105 connected at one end thereof to a power supply 101 and at the other end thereof to a plurality of ignition voltage generating circuits 104. an operational amplifier 107 making a comparison between a voltage $V_{105}$ across the resistor 105 and a reference voltage Vr which corresponds to a predetermined upper limit current for each power transistor 103 and generating an output signal A of a magnitude proportional to a difference ($V_{105}-Vr$) therebetween, and a plurality of transistors 108 provided one for each power transistor 103 and connected to receive the output signal A from the operational amplifier 107 for limiting a current through a corresponding power transistor 103 in response to the output signal A. The current limiting circuit 107 serves to sense a current flowing through each power transistor 103 and limit it to a predetermined upper limit value to thereby protect each power transistor from damage due to an overcurrent therethrough.

7 Claims, 3 Drawing Sheets

IGNITION APPARATUS FOR AN INTERNAL COMBUSTION ENGINE HAVING A CURRENT LIMITING FUNCTION

BACKGROUND OF THE INVENTION

The present invention relates to an ignition apparatus for an internal combustion engine having a current limiting function in which a switch such as a power transistor for turning on and off the power supply to an ignition coil to thereby generate a high voltage can be protected from damage due to an overcurrent flowing therethrough. More particularly, it relates to such an ignition apparatus which is simple in construction and low in the manufacturing costs.

FIG. 3 shows a typical example of an ignition apparatus for a multi-cylinder (e.g., four-cylinder in the illustration) internal combustion engine having a current limiting function. In this figure, the illustrated ignition apparatus includes a power supply in the form of a battery 1, and a plurality of ignition coils 2 provided one for each of cylinders of the engine and commonly connected to the battery 1. Each ignition coil 2 has a primary winding and a secondary winding. The primary winding of each ignition coil 2 is connected at one end thereof to the battery i and at the other end thereof to ground through a switch 3 in the form of an electronic switch comprising a pair of transistors coupled in a Darlington pair. The secondary winding of each ignition coil 2 connected to a spark plug (not shown) for a corresponding cylinder. Each switch or Darlington pair 3 has a common collector coupled to the primary winding of a corresponding ignition coil 2, an emitter connected to ground, and a base connected to an unillustrated engine control unit which periodically supplies thereto an ignition signal D at an appropriate ignition timing whereby the switch 3 is turned off, thus generating a high voltage Vi across the secondary winding which is imposed upon electrodes of a corresponding spark plug.

A current limiting circuit, generally designated at reference numeral 9, is provided for each of the switches 3 for the purpose of protecting it from an overcurrent flowing therethrough. Each current limiting circuit 9 Includes a current sensing resistor 5 having a limited resistance and connected between the emitter of a corresponding switch 3 and ground for sensing a current flowing from the battery 1 to ground through the primary winding of a corresponding ignition coil 2 and the switch 3 to generate a corresponding voltage Vt thereacross which is proportional to the current flowing through the switch 3. An operational amplifier 7 has a positive or non-inverted input terminal connected to one end (i.e., a switch-side end) of the current sensing resistor 5 to which the corresponding switch S is connected, and a negative or inverted input terminal connected to a positive terminal of a reference .voltage supply 6 whose negative terminal is connected to the other end (i.e., a ground-side end) of the resistor 5 which is connected to ground. The reference voltage supply 6 generates a reference voltage Vr corresponding to an upper limit value of a current flowing through the switch S and supplies it to the negative input terminal of the operational amplifier 7, so that the operational amplifier 7 compares the voltage Vt across the resistor 5 with the reference voltage Vr to generate an output signal or voltage A proportional to a difference (Vt−Vr) therebetween. A transistor 8 has a base coupled to an output terminal of the operational amplifier 7, a collector coupled to the base of a corresponding switch 3, and an emitter connected to ground. Thus, when the output voltage A from the operational amplifier ? exceeds a predetermined threshold value, the transistor 8 is turned on by the output signal A from the operational amplifier 7 to connect or shore-circuit the base of the switch 3 to ground through the now conductive transistor 8, thereby turning the switch 3 off to stop the current flow through the primary winding of the corresponding ignition coil 2 and the switch 3.

The operation of the above-mentioned ignition apparatus of FIG. 3 will now be described. When an ignition signal D supplied from the unillustrated engine control unit to a switch S is changed into a high level at an appropriate power supply starting timing to thereby turn the switch 3 on, a current begins to flow from the battery 1 to ground through the primary winding of an associated ignition coil 2, the switch 3 and an associated resistor 5. As a result, a voltage Vt develops across the resistor 5 and is supplied to the positive or non-inverted input terminal of the operational amplifier 7. The operational amplifier 7 compares the voltage Vt with the reference voltage Vr which is supplied from the reference power supply 6 to the negative or inverted input terminal of the amplifier 7, and it then generates an output signal A proportional to a difference (Vt−Vr) between the voltages Vt, Vr so as to control an associated transistor 8, For example, when the voltage Vt exceeds the reference voltage Vr (i.e., Vt > Vr) indicating that an overcurrent flows through the switch 3, the operational amplifier ? operates to increase the level or magnitude of its output signal A. When the output signal A from the operational amplifier 7 exceeds a predetermined threshold, the transistor 8 is made conductive so that the ignition signal D from the engine control unit is allowed to pass to ground via the now conductive transistor 8 while bypassing the switch 3. As a result, the base current to be supplied to the base of the switch 3 is suppressed. With such control of the base current, the current flowing through the switch 3 is limited to a predetermined upper limit level.

Accordingly, the current passing through each switch 3 during conduction or energization of a corresponding ignition coil 2 does not exceed the upper limit value, and hence each switch 3 is positively protected from damage due to an overcurrent passing therethrough.

In this connection, it is to be noted that in each current limiting circuit 9, a circuit constant of the resistor 5 for generating a high current sensing voltage Vt thereacross and a circuit constant of the reference voltage supply 6 are properly adjusted in advance.

Subsequently, when the ignition signal D supplied to the switch 3 becomes low at ignition timing to turn the switch 3 off, a high voltage Vi is induced across the secondary winding of a corresponding ignition coil 2 and supplied to an illustrated corresponding spark plug to thereby ignite a corresponding cylinder.

With the above-described ignition apparatus as constructed above, however, the current limiting circuits 9 are provided one for each ignition coil 2 and hence for each cylinder, so the number of the current limiting circuits required is equal to that of the cylinders, making the overall construction of the ignition apparatus complicated. As a result, it is difficult to manufacture the apparatus at reduced costs. Moreover, the resistance of the resistor 5 and the reference voltage vr for comparison with the voltage across the resistor 5 in each current limiting circuit 9 have to be respectively adjusted, which results in variations in the values of currents limited by the respective current limiting circuits 9.

Moreover, in order to detect whether a cylinder to be controlled has actually ignited, an unillustrated ignition detecting circuit may be provided as necessary. For example, such an ignition detecting circuit is constructed such that it generates an ignition detection signal to the unillustrated engine control unit when a voltage corresponding to a primary winding current flowing through the primary winding of an ignition coil 2 is less than a predetermined lower limit value required for proper ignition. Based on this ignition detection signal, the engine control unit determines whether the ignition coil 2 operates in a normal manner. If the voltage-corresponding to the primary winding current is less than the predetermined lower limit value, the engine control unit determines that the ignition coil 2 is abnormal, and it takes an appropriate measure such as stopping fuel injection to a cylinder corresponding to the abnormal ignition coil 2.

In this case, however, the ignition detecting circuit is provided independently and separately from the current limiting circuit 9, so the provision of the independent and separate ignition detecting circuit result in a further complicated construction and a further increase in the manufacturing cost.

SUMMARY OF THE INVENTION

Accordingly, the present invention is aimed at overcoming the above-described problems encountered with the above-mentioned ignition apparatus.

An object of the present invention is to provide a novel and improved ignition apparatus for an internal combustion engine having a current limiting function which is simple in construction and which can avoid variations In the current limiting values for respective switches.

Another object of the present invention is to provide an ignition apparatus for an internal combustion engine having a current limiting function as well as an Ignition detecting function which can detect whether ignition coils operate normally, and which is simple in construction and low in the cost of manufacture.

According to the present invention, there is provided in ignition apparatus for a multi-cylinder internal combustion engine comprising: a plurality of ignition voltage generating circuits provided one for each of a plurality of engine cylinders and each including an ignition coil connected to a power supply and a switch for controlling the power supply to the ignition coil in response to an ignition signal, each ignition coil being controlled by the corresponding switch to generate a high voltage for igniting a corresponding cylinder: and current limiting means for limiting a current through each switch below a predetermined level.

The current limiting means comprises: a common resistor connected between the power supply and the ignition voltage generating circuits for sensing a current flowing from the power supply to each ignition voltage generating circuit; an operational amplifier for making a comparison between a voltage across the common resistor and a reference voltage corresponding to a predetermined upper limit current for the ignition voltage Generating circuits, the operational amplifier being operable to generate an output voltage proportional to a difference between the voltage across the common resistor and the reference voltage of the reference voltage supply; and limiting means for limiting a current through the switch of each of the ignition voltage generating circuits In response to an output signal from the operational amplifier.

Preferably, the limiting means comprises a plurality of transistors provided one for each ignition voltage generating circuit, and the transistors are commonly connected to receive the output signal from the operational amplifier to be thereby controlled to switch on and off, the transistors being connected respectively to the ignition voltage generating circuits in such a manner that they operate to short-circuit, when turned on, an ignition signal to be supplied to the switch of one of the ignition voltage generating circuits to ground while bypassing the switch.

Preferably, the operational amplifier has a non-inverted input terminal connected to one end of the resistor to which the power supply is connected, an inverted input terminal connected to the other end of the resistor through a reference voltage supply.

In one form of the invention, the ignition apparatus further comprises ignition detecting means for detecting an ignition based on a current flowing through each ignition coil. The ignition detecting means comprises: the common resistor; and a comparator for making a comparison between the voltage across the resistor and a second reference voltage corresponding to a predetermined lower limit current for the ignition coil and for generating an ignition detection signal when the voltage across the resistor is greater than the predetermined lower limit current.

Preferably, the comparator has a non-inverted input terminal connected to one end of the resistor to which the power supply Is connected, and an inverted input terminal connected to the other end of the resistor through a second reference voltage supply.

The ignition detection means may further comprise: a plurality of AND gates provided one for each cylinder and each having a first input terminal connected to receive an output signal from the comparator and a second input terminal connected to receive an ignition signal for a corresponding cylinder; and an OR gate connected to receive output signals from the AND gates for generating an output signal when at least one of the output signals from the AND gates is of a high level.

The above and other objects, features and advantages of the present invention will become more readily apparent from the ensuing detailed description of a few preferred embodiments of the invention taken in conjunction with the accompanying drawings.

DESCRIPTION OF THE PREFERRED EMBODIMENTS

A few preferred embodiments of the present invention will now be described in detail with reference to the accompanying drawings.

EMBODIMENT 1

Figure 1:
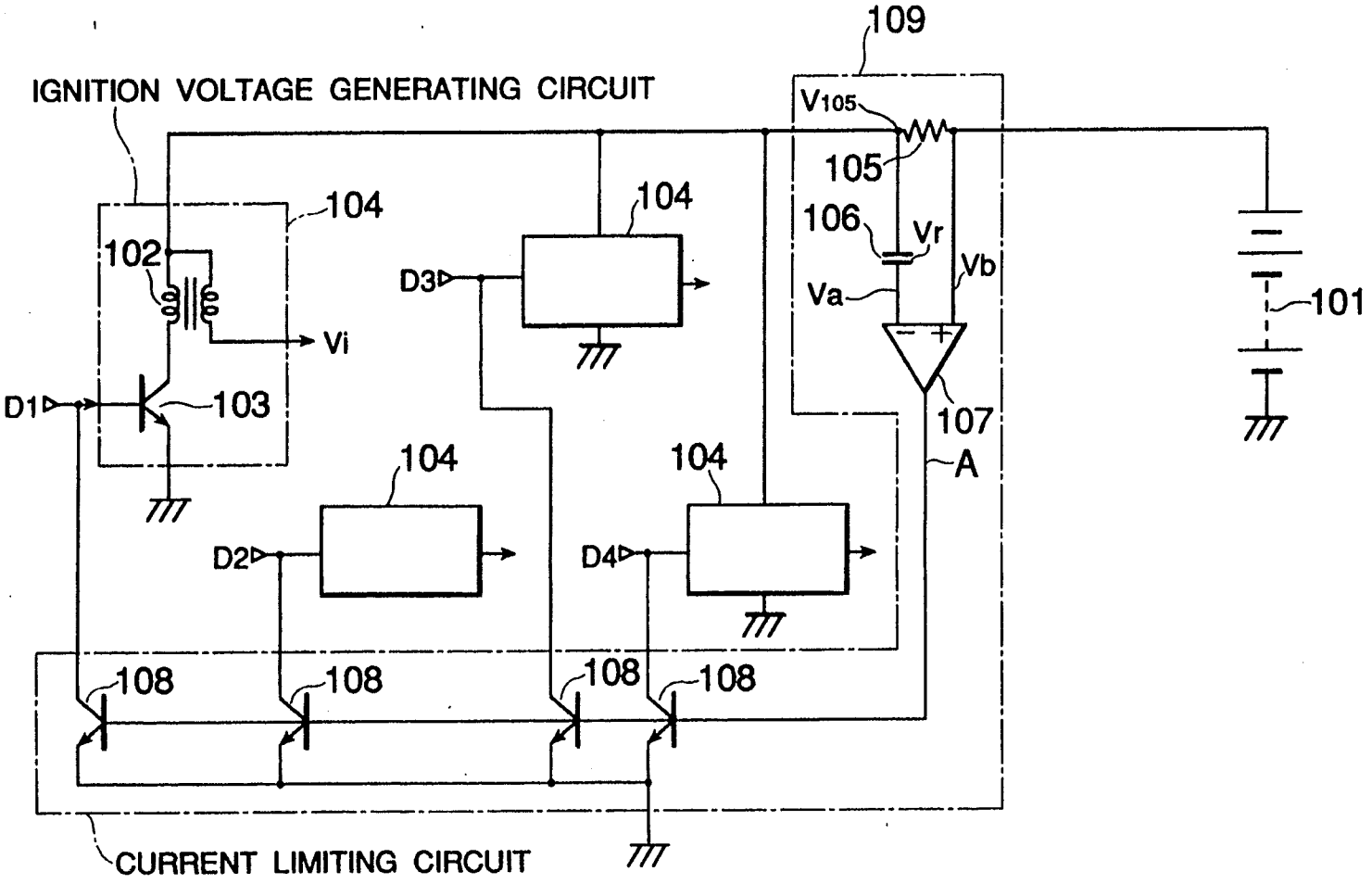
FIG. 1 is a circuit diagram of an ignition apparatus for a multi-cylinder internal combustion engine having a current limiting function in accordance with one embodiment of the present invention.

FIG. 1 shows an ignition apparatus for a multi-cylinder internal combustion engine having a current limiting function constructed in accordance with principles of the present invention. In this figure, the ignition apparatus of this embodiment is for a four-cylinder Internal combustion engine having four cylinders, and it includes a plurality of (four in the illustrated example) ignition voltage generating circuits 104 each of which comprises an ignition coil 102 and a switch 103 in the form of an electronic switch such as a power transistor. Each ignition coil 102 has a primary winding connected at one end thereof to a power supply in the form of a battery 101, and a secondary winding connected to an unillustrated corresponding spark plug. Each power transistor 103 has a collector coupled to the other end of the primary winding of a corresponding ignition coil 102, an emitter connected to ground, and a base connected to an unillustrated engine control unit which generates a plurality of ignition signals D1 through D4 which are fed to the bases of the corresponding power transistor 103.

A common current limiting circuit 109 serves to limit a current flowing through the power transistor 103 of each ignition voltage generating circuit 104, and it comprises a single common current sensing resistor 105 connected between the power supply 101 and the ignition coil 102 of each ignition voltage generating circuit 104, an operational amplifier 107 for comparing a voltage across the resistor 105 with a reference voltage Vr which corresponds to an upper limit current for each power transistor 103, and a limiting means comprising a plurality of transistors 108 for limiting a current flowing through the power transistor 103 of each ignition voltage generating circuit 104 In response to an output signal A from the operational amplifier 107.

The operational amplifier 107 has a positive or non inverted input terminal connected to one end (i.e., higher voltage end) of the common resistor 105 which is connected to the battery 101, and a negative or inverted input terminal. connected to a positive terminal of a reference voltage supply 106 whose negative terminal is connected to the other end (i.e., lower-voltage end) of the resistor 105 which is connected to the ignition voltage generating circuits 104. Thus, the operational amplifier 107 has the positive input terminal thereof supplied with a source voltage of the battery 101, and the negative input terminal thereof supplied with a total sum of a voltage $V_{105}$ at the lower-voltage end of the resistor 105 and a reference voltage Vr of the reference voltage supply 106, so that it generates an output voltage A proportional to a difference (Vb−Va) between the voltages Vb, Va at the positive and negative input terminals of the operational amplifier 107.

Thus, the following equation is established:

$$Va = Vb - V_{105} + Vr$$

The above equation is transformed as follows:

$$Vb - Va = V_{105} - Vr$$

As a result, the output signal A from the operational amplifier 10? is proportional to a difference between the voltage $V_{105}$ and the reference voltage Vr of the reference voltage supply 106.

The transistors 108 of the current limiting circuit 109 correspond in number to the ignition voltage generating circuits 104, and they are provided one for each ignition voltage generating circuit 104. Each of the transistors 108 has a collector coupled to the base of the power transistor 103 of a corresponding ignition voltage generating circuit 104, a base commonly connected to the output terminal of the operational amplifier 107, and an emitter connected to ground. Thus, the transistors 108 are commonly controlled by the output signal A from the operational amplifier 107.

Figure 3:
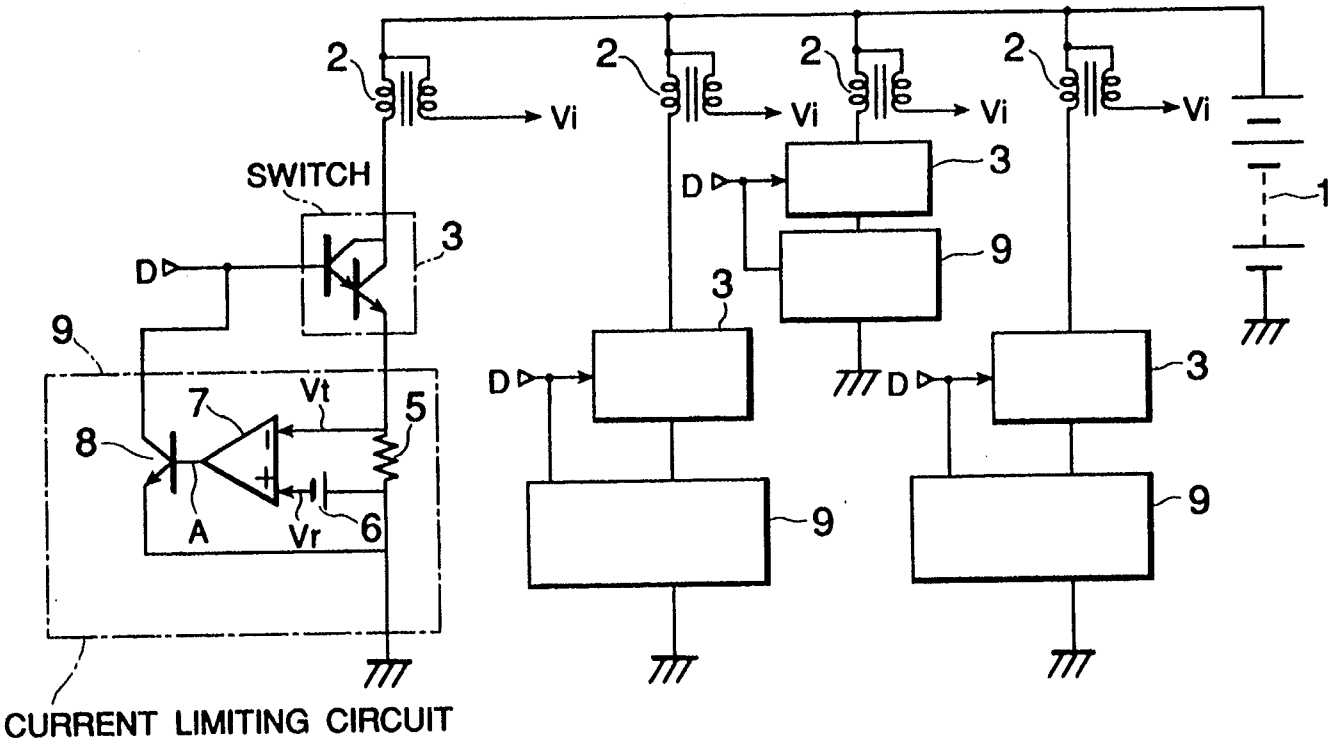
FIG. 3 is a circuit diagram of an example of an ignition apparatus for a multi-cylinder internal combustion engine having a current limiting function, which involves problems to be solved by the invention.

The operation of this embodiment will be described below in detail. However, the basic operation thereof is substantially similar to that of the previously described apparatus of FIG. 3, and a repeated description thereof will be unnecessary.

When an ignition signal D1 from the unillustrated engine control unit supplied to one of the power transistors 103 is changed into a high level to turn it son, a current begins to flow from the battery 101 to ground through the common resistor 105, the primary winding of an associated ignition coil 102 and the now conductive power transistor 103. A voltage $V_{105}$ is thus developed across the resistor 105.

Consequently, the operational amplifier 107 generates an output signal A which is proportional to the difference between the source or battery voltage Vb and the comparison voltage Va (i.e., the voltage $V_{105}$ plus the reference voltage Vr) at positive and negative input terminals, respectively, so that the transistors 108 are thereby controlled to turn on and off.

Specifically, when the current flowing from the battery 101 to ground through the common resistor 105, the primary winding of an associated ignition coil 102 and the associated power transistor 103 exceeds a predetermined level, the output signal or voltage A from the operational amplifier 107, which is proportional to the difference (Vb−Va) between the source voltage Vb and the comparison voltage Va and hence to the difference ($V_{105}$−Vr) between the voltage $V_{105}$ and the reference voltage Vr of the reference voltage supply 106 as referred to above, increases above a prescribed threshold value for each transistor 108, whereby the transistors 108 are all turned on to short-circuit the bases of the power transistors 103. Thus, the ignition signal D1 of a high level from the unillustrated engine control unit to be supplied to one of the power transistors 103 is allowed to pass to ground through the now conductive corresponding transistor 108, and it is therefore prevented from being supplied to the base of the corresponding power transistor 103. As a result, the corresponding power transistor 103 is turned off, stopping the current flow through the primary winding of the associated ignition coil 102. In this manner, an overcurrent or a current having an excessive magnitude is prevented from flowing through each power transistor 103. In other words, by use of the single current limiting circuit 109, it is possible to limit the current through the power transistor 103 of each ignition voltage generating circuit 104 below a prescribed value. This serves to not only simplify the overall arrangement of the current limiting circuit 109 but also reduce or eliminate variations in adjustment of the resistance of the current sensing resistor 105 and the reference voltage Vr of the reference voltage supply 106, which would otherwise result from the use of a plurality of current sensing resistors and a plurality of reference voltage supplies as in the case of the previously described apparatus of FIG. 3.

EMBODIMENT 2

Figure 2:
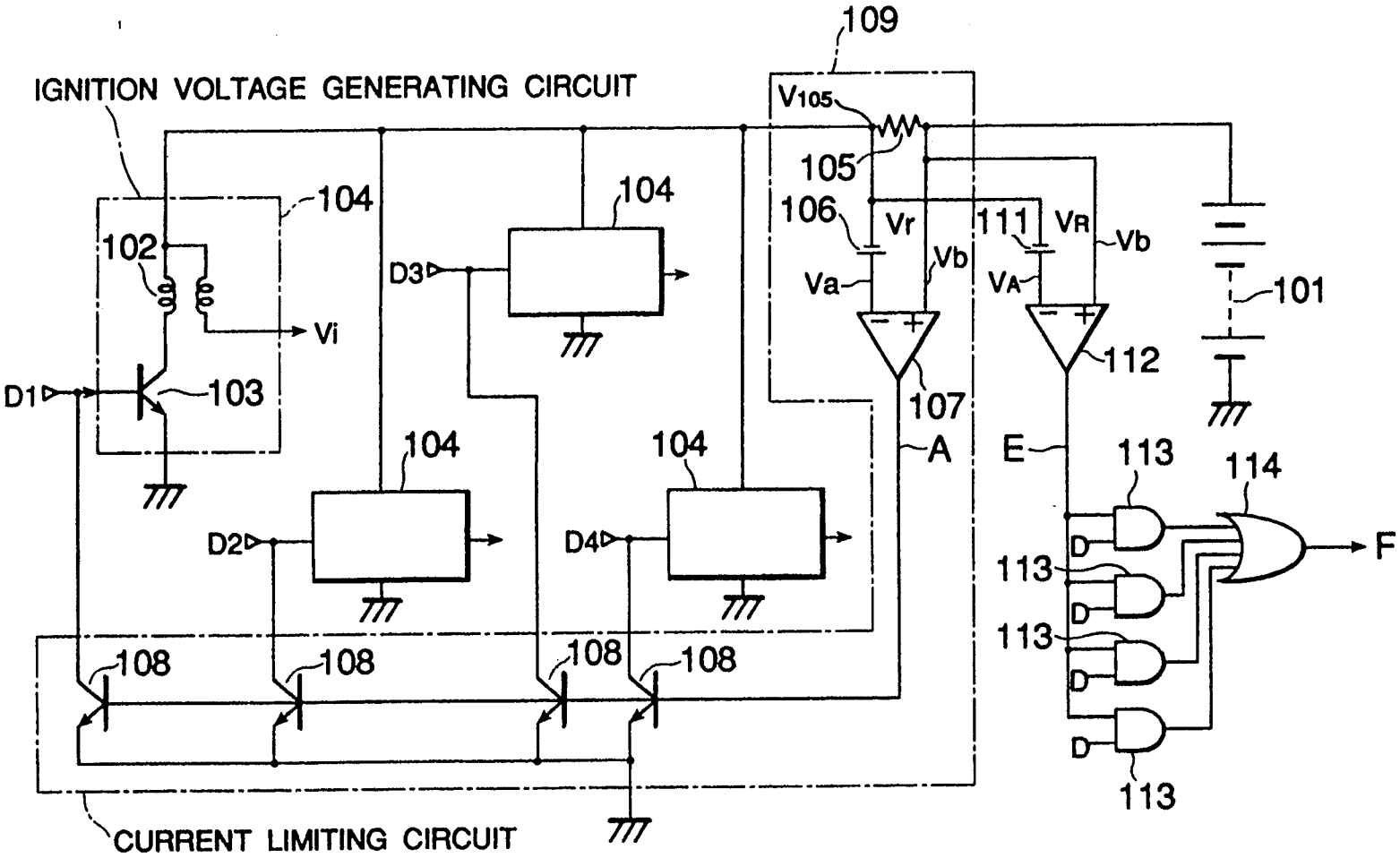
FIG. 2 is a circuit diagram of an ignition apparatus for a multi-cylinder internal combustion engine having a current limiting function as well as an ignition detecting function in accordance with another embodiment of the present invention.

FIG. 2 shows another embodiment of the invention which is applied to an ignition apparatus having a current limiting function as well as an ignition detecting function.

This embodiment is substantially similar to the abovedescribed first embodiment except for the following construction. A comparator 112 has a positive or noninverted input terminal connected to one end of the common current sensing resistor 105 which is connected to the battery 101, a negative or inverted input terminal connected to a positive terminal of a second reference power supply 111 whose negative terminal is connected to the other end of the current sensing resistor 105 which is commonly connected to the ignition voltage generating circuits 104. The second reference voltage supply 111 generates a second reference voltage VR which corresponds to a prescribed lower limit current of each ignition coil 102 as required for causing ignition. The second reference voltage VR is less than the first reference voltage Vr of the first reference voltage supply 106. The comparator 112 compares the source voltage Vb of the battery 101 at the one end of the resistor 105 input to the positive input terminal thereof with a comparison voltage VA (i.e., a total sum of the voltage $V_{105}$ and the second reference voltage VR of the second reference voltage supply 111) which is input to the negative input terminal thereof, so that it generates an output signal E indicative of detection of a normal ignition when the comparison voltage VA is greater than the source voltage Vb, i.e., when the voltage $V_{105}$ is greater than the second reference voltage VR of the second reference voltage supply 111. In this connection, there establishes the following equation:

$$Vb - VA = V_{105} - VR$$

In other words, if there exists a primary winding current of a magnitude greater than the prescribed lower limit flowing through the primary winding of an ignition coil 102, the voltage $V_{105}$ becomes greater than the second reference voltage VR, so the comparator 112 generates an ignition detection signal E. Thus, the occurrence of an ignition is reliably detected on the basis of the ignition detection signal E.

The resistor 105, the second reference voltage supply 112 and the comparator 112 together constitute an ignition detection circuit for detecting a normal ignition based on a current flowing through the primary winding of each ignition coil 102.

A plurality of AND gates 113 are provided which correspond in number to the cylinders of the engine and hence to the ignition voltage generating circuits 104. Each of the AND gates 113 has a first input terminal connected to an output terminal of the comparator 112, a second input terminal connected to an unillustrated engine control apparatus so as to receive an ignition signal D1, D2, D3 or D4 for a corresponding cylinder, and an output terminal connected to a corresponding input terminal of an OR gate 114. Each AND gate 113 generates an output signal of a high level to the OR gate 114 when the input signals are both high. The OR gate 114 generates a logical output signal F indicative of generation of an ignition detection signal E for each cylinder when any of the AND gates 113 generates a high-level output signal. At least one of the ignition detection signals E from the comparator 112 and the logical output signal F from the OR gate 114 is fed to the unillustrated engine control unit for properly control the engine operation.

In this embodiment, the resistor 105 serves as a dual function component which acts as a part of the current limiting circuit 109 and also as a part of the ignition detection circuit.

Moreover, in this embodiment, with the use of the AND gates 113, each of which generates a high-level output signal when there exist both of an ignition detection signal E and an ignition signal D1, D2, D3 or D4 for a corresponding cylinder, in combination with the OR gate 114, which generates an output signal F when there exists a high-level output signal from any of the AND gates 113, a logical output signal is obtained as a highly reliable ignition detection signal in correspondence to each ignition signal D1, D2; D3 or D4.

With the use of the dual function current sensing resistor 105 for the current limiting circuit 109 as well as for the ignition detection circuit, the apparatus as a whole can be further simplified and manufactured at reduced costs.

What is claimed is:

1. An ignition apparatus for a multicylinder internal combustion engine comprising:

a plurality of ignition voltage generating circuits provided one for each of a plurality of engine cylinders and each including an ignition coil coupled to a power supply and a switch for controlling the power supplied to the ignition coil in response to an ignition signal, each ignition coil being controlled by said corresponding switch to generate a high voltage for igniting a corresponding cylinder;

current limiting means for limiting a current through each switch below a predetermined level, comprising:

a common resistor coupled between said power supply and each of said ignition voltage generating circuits for sensing a current flowing from said power supply to each ignition voltage generating circuit;

an operational amplifier, for comparing a voltage across said common resistor and a reference voltage corresponding to a predetermined upper limit current for said ignition voltage generating circuits, to generate an output voltage proportional to a difference between said voltage across said common resistor and said reference voltage;

limiting means for limiting a current through said switch of each of said ignition voltage generating circuits in response to said output voltage from said operational amplifier; and ignition detecting means for detecting an ignition based on a current flowing through each ignition coil by comparing said voltage across said common resistor and a second reference voltage corresponding to a predetermined lower limit current for said ignition coil, and for generating an ignition detection signal when said voltage across said resistor is greater than said predetermined lower limit current.

2. An ignition apparatus according to claim 1, wherein said limiting means comprises a plurality of transistors provided one for each ignition voltage generating circuit, said transistors being commonly coupled to receive the output voltage from said operational amplifier to be controlled by said output voltage to switch on and off, said transistors being coupled respectively to said ignition voltage generating circuits to short-circuit, when turned on, said ignition signal supplied to said switch of any of said ignition voltage generating circuits to ground while bypassing said switch.

3. An ignition apparatus according to claim 1, wherein said operational amplifier has a non-inverted input terminal coupled to one end of said common resistor and an inverted input terminal coupled through a reference voltage supply to the end of said resistor coupled to said ignition voltage generating circuits.

4. An ignition apparatus according to claim 1, wherein each of said ignition coils has a primary winding and a secondary winding coupled to a spark plug, and each of said switches comprises a transistor switch.

5. An ignition apparatus for a multi-cylinder internal combustion engine comprising:

a plurality of ignition voltage generating circuits provided one for each of a plurality of engine cylinders and each including an ignition coil coupled to a power supply and a switch for controlling the power supplied to the ignition coil in response to an ignition signal, each ignition coil being controlled by said corresponding switch to generate a high voltage for igniting a corresponding cylinder;

current limiting means for limiting a current through each switch below a predetermined level; and ignition detecting means for detecting an ignition based on a current flowing through each ignition coil;

said current limiting means comprising:

a common resistor coupled between said power supply and each of said ignition voltage generating circuits for sensing a current flowing from said power supply to each ignition voltage generating circuit;

an operational amplifier for comparing a voltage across said common resistor and a reference voltage corresponding to a predetermined upper limit current for said ignition voltage generating circuits, to generate an output voltage proportional to a difference between said voltage across said common resistor and said reference voltage; and limiting means for limiting a current through said switch of each of said ignition voltage generating circuits in response to said output voltage from said operational amplifier;

said ignition detecting means comprising:

said common resistor; and a comparator for comparing said voltage across said common resistor and a second reference voltage corresponding to a predetermined lower limit current for said ignition coil and for generating an ignition detection signal when said voltage across said resistor is greater than said predetermined lower limit current.

6. An ignition apparatus according to claim 5, wherein said comparator has a non-inverted input terminal coupled to one end of said common resistor to which said power supply is coupled, and an inverted input terminal coupled through a second reference voltage supply to the end of said resistor coupled to said ignition voltage.

7. An ignition apparatus according to claim 5, wherein said ignition detection means further comprising:

a plurality of AND gates provided one for each cylinder and each having a first input terminal connected to receive an output signal from said comparator and a second input terminal connected to receive an ignition signal for a corresponding cylinder; and an OR gate connected to receive output signals from said AND gates for generating an output signal when at least one of said output signals from said AND gates is of a high level.

* * * * *